US006983561B2

(12) United States Patent
Warren

(10) Patent No.: US 6,983,561 B2
(45) Date of Patent: Jan. 10, 2006

(54) VERTICAL PLANT STAND

(76) Inventor: William Charles Warren, 16445 County Rd. 455, Montverde, FL (US) 34756

( * ) Notice: Subject to any disclaimer, the term of this patent is extended or adjusted under 35 U.S.C. 154(b) by 0 days.

(21) Appl. No.: 11/056,713

(22) Filed: Feb. 11, 2005

(65) Prior Publication Data

US 2005/0166449 A1 Aug. 4, 2005

Related U.S. Application Data

(62) Division of application No. 10/638,593, filed on Aug. 11, 2003, now Pat. No. 6,895,713.

(51) Int. Cl.
*A47G 7/00* (2006.01)

(52) U.S. Cl. ..... 47/39

(58) Field of Classification Search ..... 47/39; 211/205; 248/121
See application file for complete search history.

(56) References Cited

U.S. PATENT DOCUMENTS

| | | | | |
|---|---|---|---|---|
| 217,010 | A | 7/1879 | Hancock | |
| 419,484 | A | 1/1890 | Wayland | |
| 1,396,445 | A | 11/1921 | Loudon | |
| 1,451,515 | A | 4/1923 | Niemczewski | |
| 1,556,373 | A * | 10/1925 | Herman | 47/47 |
| 1,976,264 | A * | 10/1934 | Miner et al. | 52/165 |
| 2,187,159 | A * | 1/1940 | Koch | 248/121 |
| 2,241,463 | A | 5/1941 | Keller | |
| 2,520,450 | A * | 8/1950 | Austin, Jr. | 248/125.1 |
| 2,746,208 | A | 5/1956 | Lewis | |
| 3,030,735 | A | 4/1962 | Bodkins | |
| 3,262,665 | A * | 7/1966 | Black | 248/153 |
| 3,554,473 | A | 1/1971 | Rakov | |
| 3,675,783 | A * | 7/1972 | Reese | 211/85.19 |
| 4,125,965 | A | 11/1978 | Schweim | |
| 4,250,666 | A | 2/1981 | Rakestraw | |
| 4,584,792 | A * | 4/1986 | Etzel | 47/70 |
| 4,747,494 | A | 5/1988 | Tyson | |
| 5,037,049 | A * | 8/1991 | Funk | 248/165 |
| 5,199,213 | A | 4/1993 | Krebs et al. | |
| 5,279,072 | A | 1/1994 | Garbo | |
| 5,438,797 | A | 8/1995 | Lendel | |
| 5,450,692 | A * | 9/1995 | Ruibal | 47/83 |
| 5,487,476 | A | 1/1996 | Barfield | |
| 5,502,922 | A | 4/1996 | Shlomo | |
| 5,598,662 | A * | 2/1997 | Droste | 47/39 |
| D410,804 | S | 6/1999 | Murray | |
| 5,934,014 | A | 8/1999 | Carrothers | |
| 5,967,359 | A | 10/1999 | Mindell | |

(Continued)

FOREIGN PATENT DOCUMENTS

FR 2644338 A1 * 9/1990

(Continued)

*Primary Examiner*—Francis T. Palo
(74) *Attorney, Agent, or Firm*—Dennis G. LaPointe

(57) ABSTRACT

A vertical plant stand that is free standing or can be supported by burying its lower end in a base plant pot or in the ground. Pots can be angularly stacked along a central elongate member or hook style appendages can protrude from the central elongate member to mount tilted plant pots. Multiple vertically and/or radially spaced-apart appendages can be included to mount tilted pots like tree branches. The stand can also be configured for mounting a table top to the stand for making an end table, coffee table or other table design. Instead of a table top, a top plant pot may be provided at the upper end of the central elongate member.

3 Claims, 9 Drawing Sheets

U.S. PATENT DOCUMENTS

| | | | | |
|---|---|---|---|---|
| 6,029,937 | A | 2/2000 | Funaro | |
| D444,958 | S | 7/2001 | Lindberg | |
| D458,093 | S * | 6/2002 | Washek | D8/1 |
| 6,425,555 | B1 | 7/2002 | Hedeman | |
| 6,557,297 | B2 | 5/2003 | Receveur | |
| 6,557,806 | B2 | 5/2003 | Davies | |
| 2005/0132644 | A1 * | 6/2005 | Schreiber | 47/39 |

FOREIGN PATENT DOCUMENTS

| | | | |
|---|---|---|---|
| GB | 2191673 | A * | 12/1987 |

* cited by examiner

VERTICAL PLANT STAND

CROSS REFERENCE TO RELATED APPLICATIONS

This application is a division of U.S. Ser. No. 10/638,593, filed Aug. 11, 2003, now U.S. Pat. No. 6,895,713; the contents of which are hereby expressly incorporated herein by reference.

The invention relates to potted plant holders, and more specifically, to a device for holding multiple plants either in a stacked or tree-limb like configuration.

There are potted plant stands known in the art that require multiple segment assembly and/or cross-members to support its stacked pots, such as those disclosed in U.S. Pat. No. 5,450,692 to Ruibal and U.S. Pat. No. 5,438,797 to Lendel. The Ruibal device has wire baskets which act as part of the support structure; cross arms are used throughout the stand to support the baskets in place; the support pole passes through a hole in the cross arms and then through the hole in the wire baskets or other plant holders; the device uses cross arms, collars, connectors, rings, couplings, and nuts to secure the baskets and parts of the stand; and assembly of the structure is required. Lendel's structure is made of several pipe segments and a plurality of locking collars, and multi-functional platforms; has a plurality of central arms attached to a vertical post; pots are supported by metal pins or side bars inserted through the support pole and the locking collars; the fixture uses a water tube going up through the pipe to water the plants; pots are stacked on top of each other vertically flat, in a centered position; the structure permits partial use of pot surfaces only; and detachable support legs are optionally added.

What is needed is a vertical pot stand that is uncomplicated in parts, requires no assembly to mount potted plants and lends itself to stacking or orienting plants in a tilted orientation for more versatility in presentation, use and aesthetic appearance in a home environment.

SUMMARY OF THE INVENTION

The present invention is a vertical plant stand that is free standing or can be supported by burying its lower end in a base plant pot or in the ground. Pots can be angularly stacked along a central elongate member or hook style appendages can protrude from the central elongate member to mount tilted plant pots. Multiple vertically and/or radially spaced-apart appendages can be included to mount tilted pots like tree branches. The appendages can be simple rods or bars bent in a general L-shape or C-shape. The pots have a central hole at the bottom of the pots through which the vertically oriented portion of each appendage is inserted for mounting and supporting the pot in a tilted orientation. The stand can also be configured for mounting a table top to the stand for making an end table, coffee table of other table design. Instead of a table top, a top plant pot may be provided at the upper end of the central elongate member.

DETAILED DESCRIPTION OF THE DRAWINGS

Figure 1:
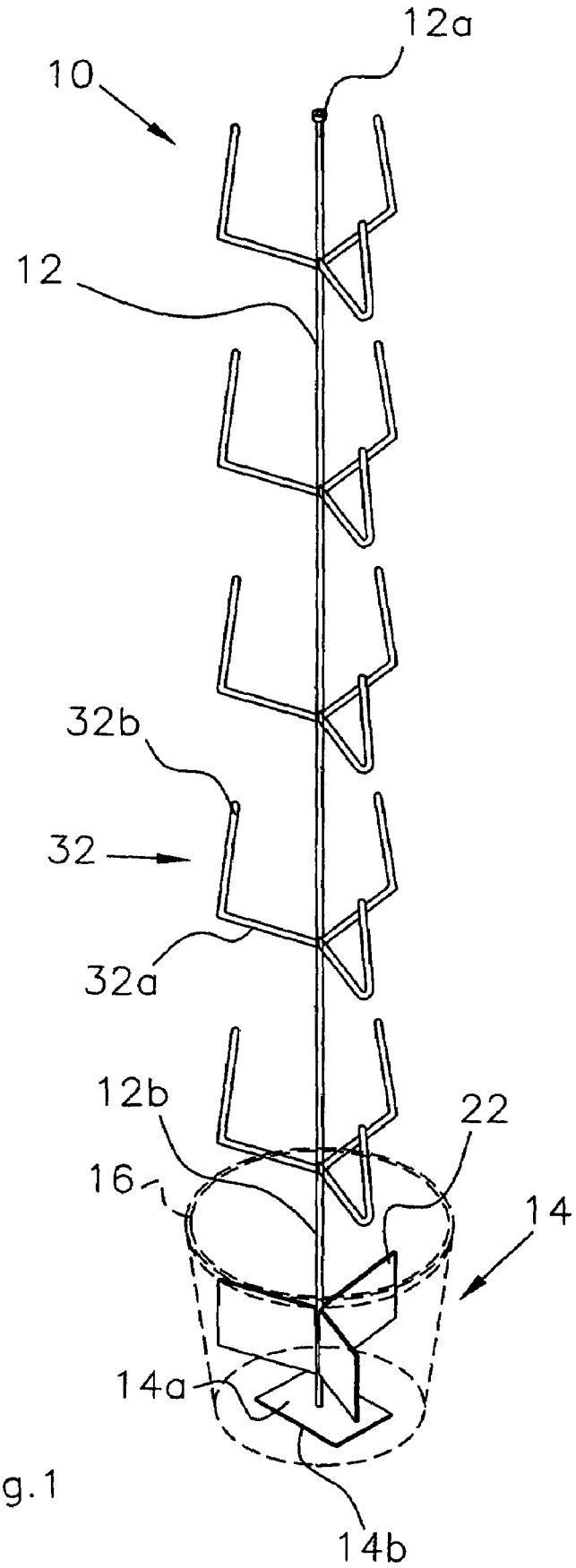
FIG. 1 is an example of one embodiment of the present invention with the stand inside a base pot only and without the mounted tilted pots on the hooked-shaped members.

Referring now to the drawings, FIGS. 1–7 depict schematically various embodiments of the present invention, which is a vertical plant stand and is depicted generally as 10.

One embodiment of the stand 10 has an elongate vertical member 12 having an upper end 12*a* and a lower end 12*b*. This elongate vertical member 12 can be a central rod or other bar stock. The lower end 12*b* has means 14 for providing vertical support located at the lower end 12*b* of the elongate vertical member 12.

Figure 2:
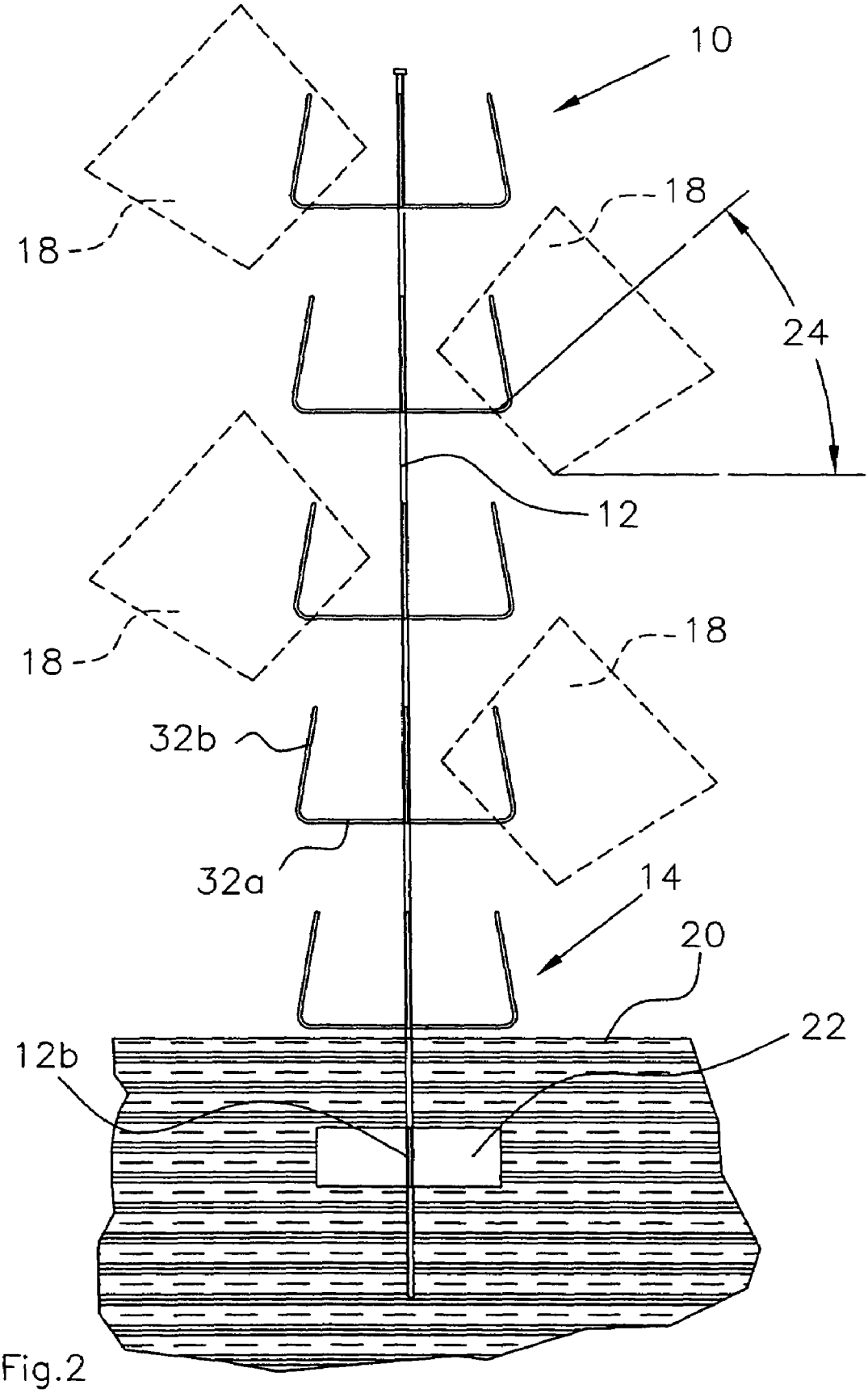
FIG. 2 is another example of an embodiment of the present invention where the stand is buried in the ground and the pots are shown in phantom for sake of simplicity.
Figure 3:
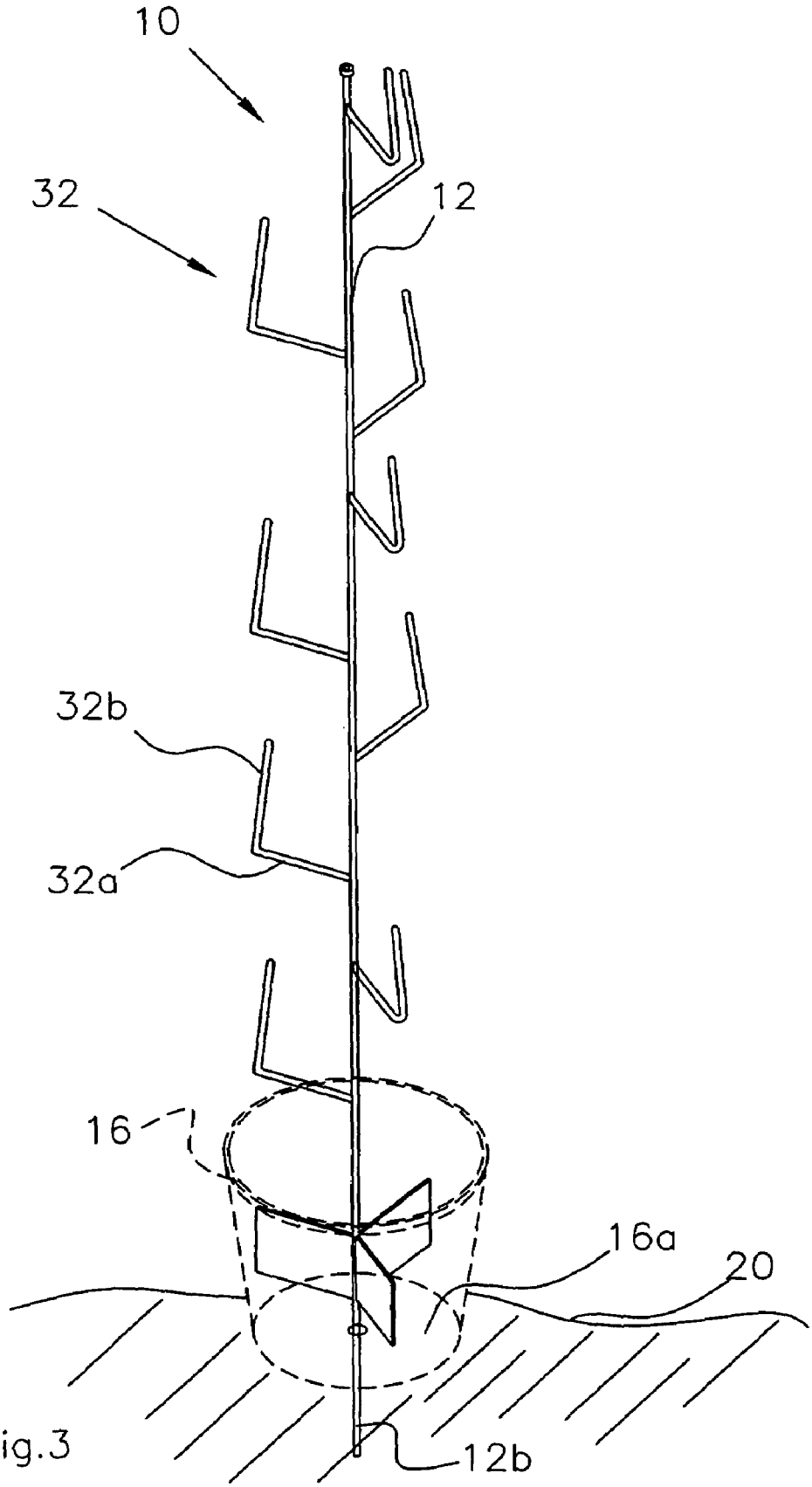
FIG. 3 is a representational schematic of the embodiment similar to FIG. 1 except the vertical member extends through the bottom of the base pot into the ground below the base pot.

The means 14 for providing vertical support located at the lower end 12*b* of the elongate vertical member 12 may be a generally planar base member 14*a*. Although, when buried in the ground, the planar base member 14*a* may be any desired dimensional shape and size, for applications where the lower end 12*b* and its planar base member 14*a* are inserted into a base plant pot 16, the generally planar base member 14*a* should be configured such that its maximum cross-sectional dimension is such that a lower face 14*b* of the base member 14*a* can rest in a face to face relationship with an inside bottom surface 16*a* of the base plant pot 16. Of course, a planar base member 14*a* is not necessary when the elongate vertical member 12 (lower end 12*b*) extends through a center hole of a base pot 16 and is buried or pinned in the ground as shown in FIGS. 2, 3 and 5*a*.

Figure 4A:
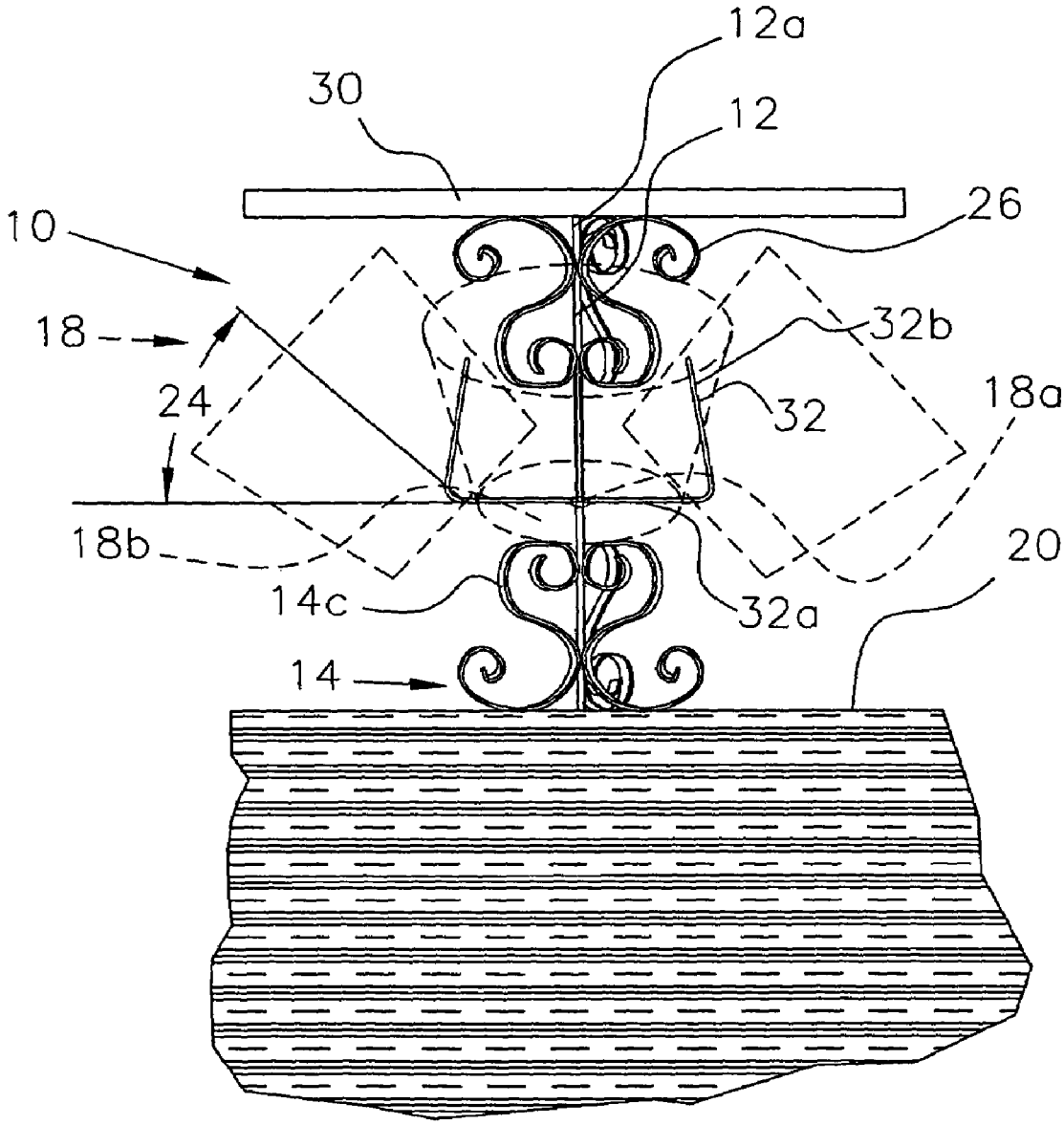
FIG. 4*a* is an example of another embodiment which is representational only of a table configuration and the vertical support means are legs, in this case decorative legs, typically 3–4 legs being contemplated as typical but 2 being shown for sake of simplicity to the drawing, and one plane of tilted pots (phantom) are shown but more than one being contemplated for high top table.
Figure 4B:
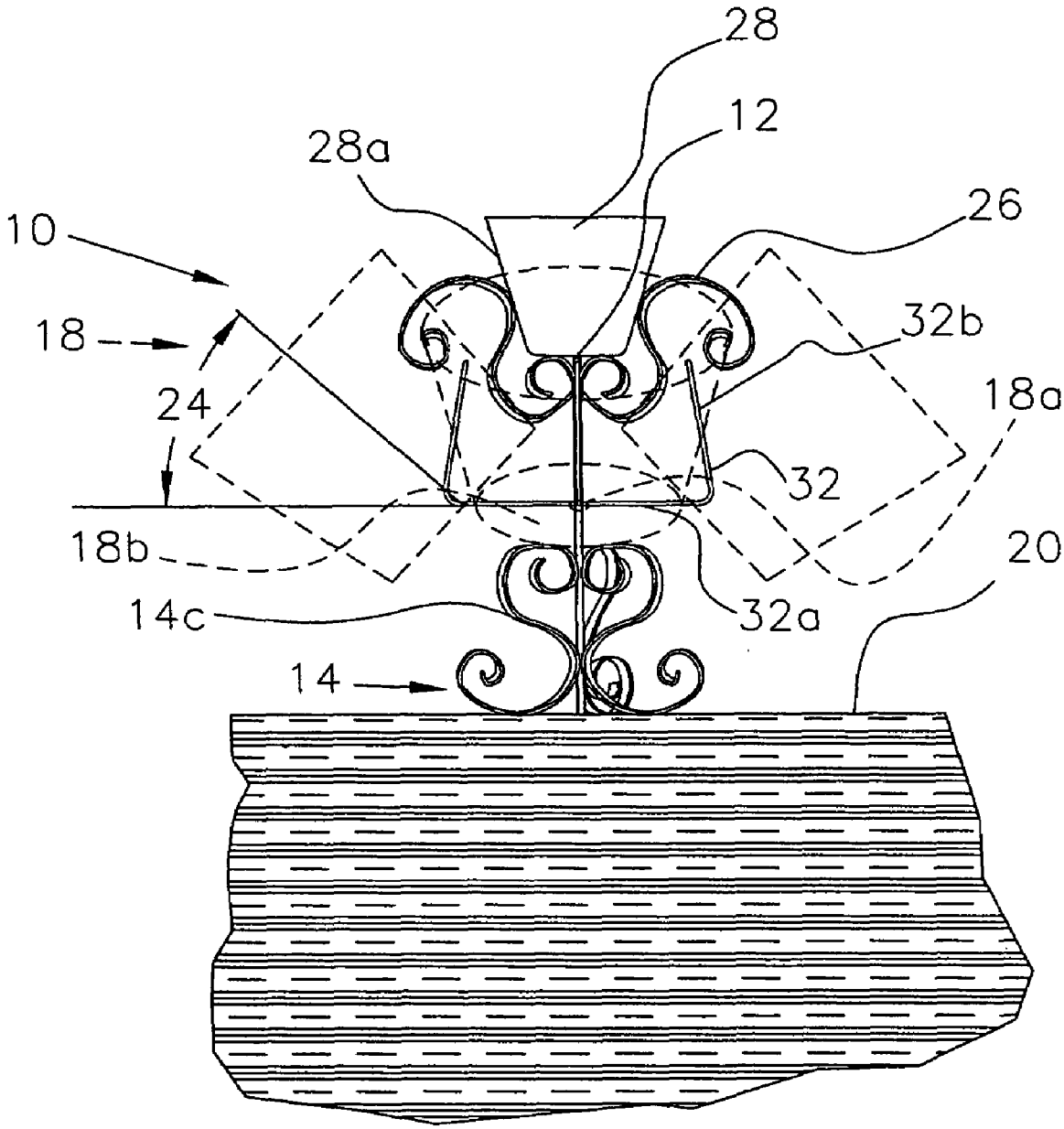
FIG. 4*b* is an example of another embodiment similar to that of FIG. 4*a* except support members (which may be decorative) are present at the top for supporting a centrally placed top pot.
Figure 5A:
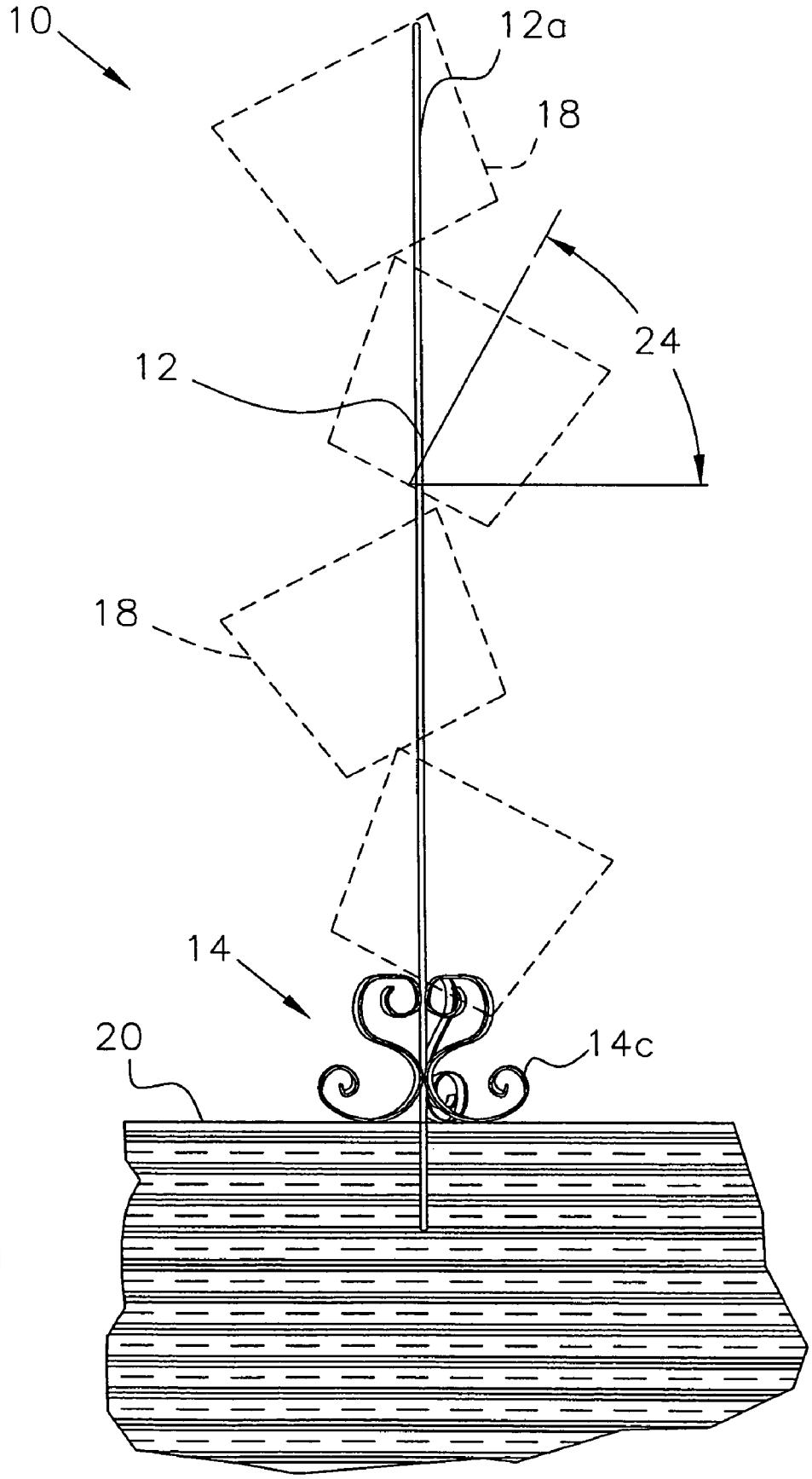
FIG. 5*a* is again another representational schematic of another embodiment where the pots are stacked one on top of the other along the central vertical member in a tilted staggered configuration with vertical support legs (2 being shown for simplicity but 3–4 being contemplated as typical)
Figure 5B:
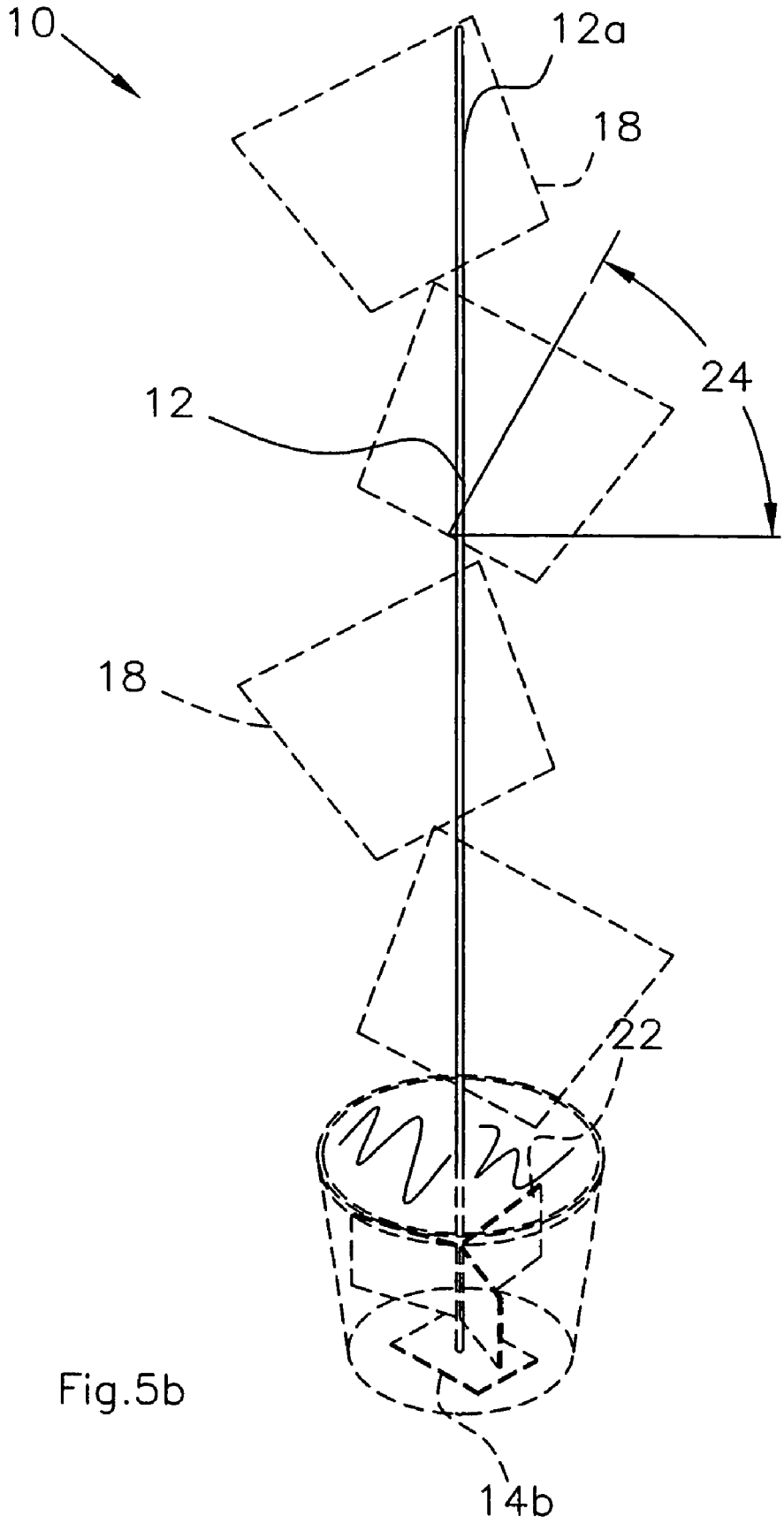
FIG. 5*b* is a schematic representational embodiment similar to that of FIG. 5*a* except the stand is located inside a base pot and the staggered tilted stacked pots are shown in phantom for sake of simplicity.
Figure 6:
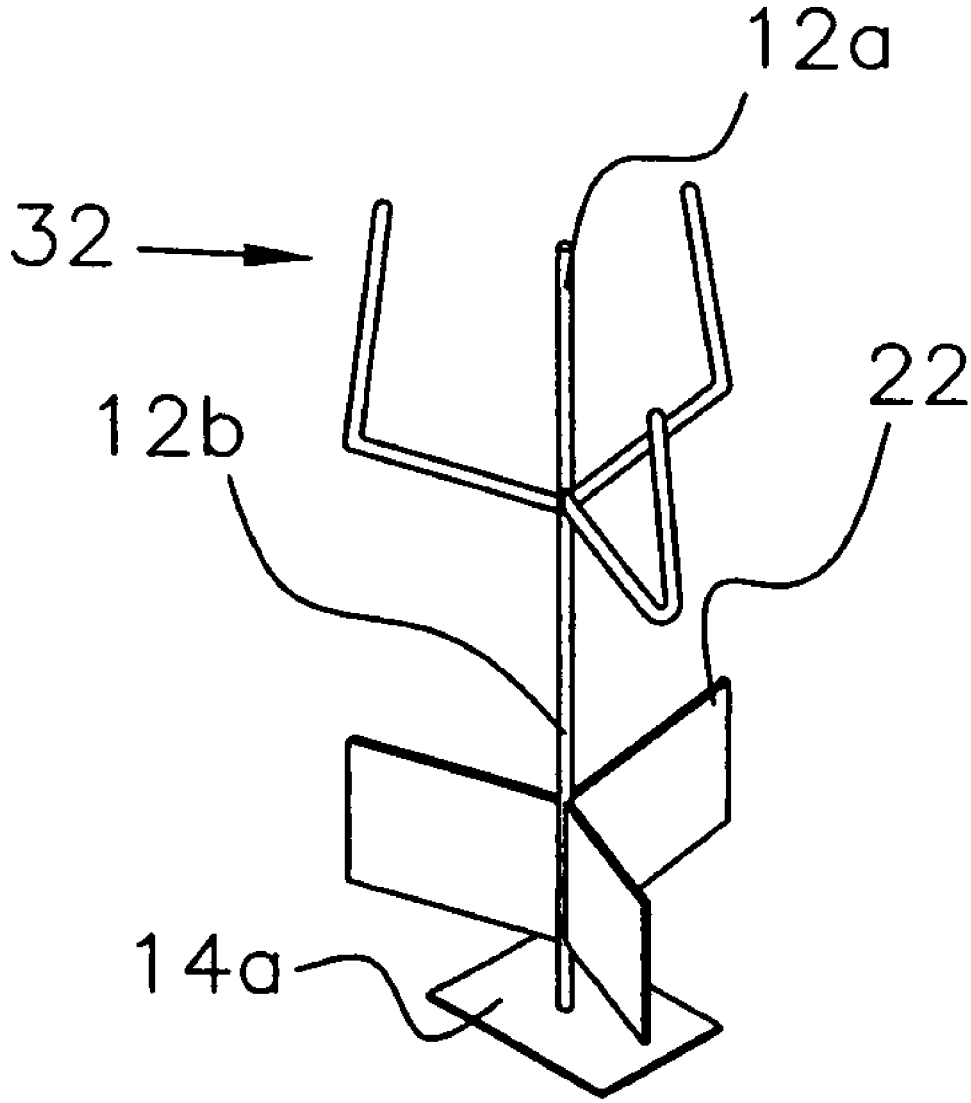
FIG. 6 is an example of the inventive pot stand without pots being depicted and a single plane of hook-shaped members are radially aligned.
Figure 7:
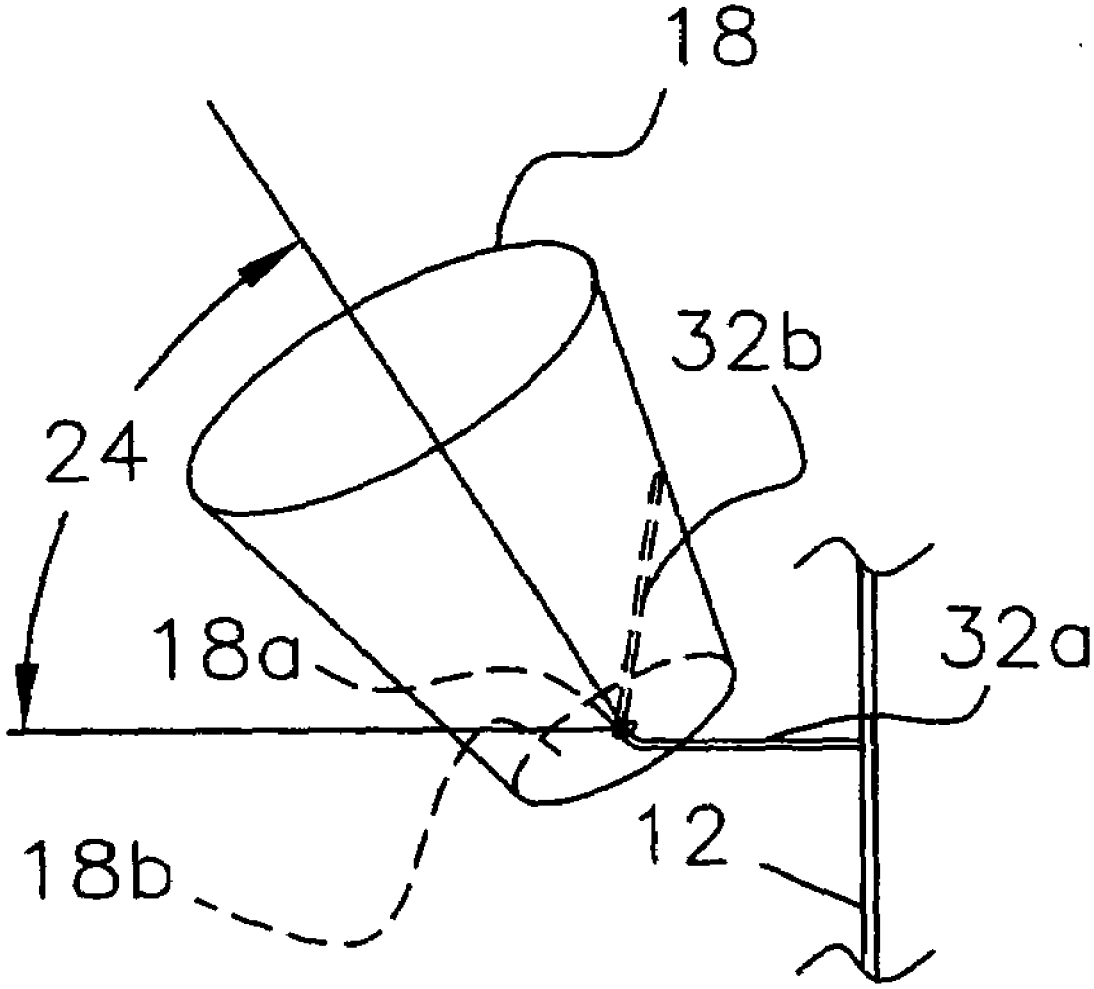
FIG. 7 is an exploded view of a part of the invention to demonstrate the typical tilt of the pot on a hook-shaped member.

In addition, in lieu of a planar base member 14*a*, a plurality of support legs 14*c* (typically 3–4) as shown in FIGS. 4*a*, 4*b* and 5*a* may be incorporated. Only three legs are shown in the drawings for sake of simplicity. As described below for the table type of the design, each support leg 14*c* should project outwardly from the elongate vertical member 12 and be upwardly directed. A shown in the drawings by example, support legs 14*c* can be decoratively designed such as an "S" style design. Not only does this provide an aesthetic appeal but it also provides for a bracing effect between the elongate vertical member 12 and the ground surface. The placement of a gusset as a bracing member welded to a rod iron elongate vertical member 12 to provide for stability would be an example of a support leg 14*c*.

Two or more plant pots 18, each having a central hole 18*a* at their respective bottom portions 18*b* are mounted to the stand 10. The central holes 18*a* are sized so that when the elongate vertical member 12 is passed through the central hole 18*a* of each of the two or more plant pots 18, the plant pots 18 can each be tilted at an angle 24 and stacked sequentially at approximately said angularly tilted configuration. The plant pots 18, which are sequentially stacked along the elongate vertical member 12 at the angularly tilted configuration, provide a functional garden like display and aesthetically pleasing appearance, especially when filled with flowers or other plants.

The means 14 for providing vertical support located at the lower end 12*b* of the elongate vertical member 12 may be configured as mentioned above to be insertable in a base plant pot 18, restable on a ground surface 20, or buried below the ground surface 20.

In another application of the present invention 10, two or more radially-spaced apart fins 22 are included. The fins 22 extend outwardly from and are vertically oriented along the elongate vertical member 12, a predetermined distance from the base member 14*a*, such that when the vertical plant stand 10 is inserted and rested on the bottom surface 16*a* of the base plant pot 16, the fins 22 do not extend vertically beyond the top edge of the base plant pot 16 or if buried below the ground surface 20, are not exposed above the ground surface 20.

The elongate vertical member 12 and the means 14 for providing vertical support located at the lower end 12*b* of the elongate vertical member 12 can be made from a variety of materials including, but not limited to, wood materials, metal materials such as rod iron, polymeric materials, reinforced composites of polymeric materials and combinations thereof.

The preferred angularly tilted configuration, that is, each angle 24 of each of the two or more plant pots 18 when arranged on the stand 10, is about 60 to 80 degrees from horizontal.

In another embodiment of the present invention 10, the upper end 12*a* of the elongate vertical member 12 has a plurality of radially spaced-apart support members 26 (typically at least 3), where the support members 26 project outwardly from the elongate vertical member 12 and are upwardly directed. Each of the support members 26 are also aligned so as to be essentially on a same plane. These can be decoratively designed typical of rod iron design or in an S-style design. Using this embodiment, one application is the inclusion of a plant stand top plant pot 28. The top plant pot 28 is typically mountable in an overlying relationship with the upper end 12*a* of the vertical elongate member 12 and is generally supported on its perimeter side 28*a* with the radially spaced-apart support members 26. The top plant pot 28 may also have a central hole 18*a* through which the upper end 12*a* of the elongate vertical member 12 may be partially inserted.

In still another application, a table top 30 is in an overlying relationship with each of the radially spaced-apart support members 26 which are aligned so as to be essentially on the same plane. This can be a glass, metal or wooden table top or any combinations thereof. The top can just rest on the stand or be attached with some fasteners. Possible uses include end tables, coffee tables, high bar top type stands/tables.

In still another embodiment of the present invention 10, a plurality of elongated generally hook-shaped members 32 are included, where a proximal portion 32*a* of each hook-shaped member 32 is attached to the elongate vertical member 12 and projects in a generally horizontal direction away from the elongate vertical member 12, and a distal portion 32*b* of each hook-shaped member 32 is directed in a generally vertical upwardly direction.

The hook-shaped members 32 can be configured either longitudinally spaced-apart along the elongate vertical member 12, radially spaced-apart around the elongate vertical member 12, or can be configured to include a combination of being longitudinally spaced-apart along the elongate vertical member 12 and radially spaced-apart around the elongate vertical member 12.

A plurality of plant pots 18, each having a central hole 18*a* at their respective bottom portions 18*b* are mountable on each of the hook-shaped members 32. The central hole 18*a* of each of the plurality of plant pots 18 is sized so that when the distal portion 32*b* of each hook-shaped member 32 which is generally directed vertically upwardly, is passed through the central hole 18*a* of each of the plurality of plant pots 18, the plant pots 18 can each be tilted at an angular configuration, that is, angle 24, as shown on the drawings. The angularly tilted configuration of each of the plurality of plant pots in this embodiment is also contemplated to be about 60 to 80 degrees from horizontal.

Again, it is contemplated that the various components of the above embodiments, that is, the components making up the stand 10, can be made from materials such as wood materials, metal materials, polymeric materials, reinforced composites of polymeric materials and combinations of such materials.

The upper end 12*a* of the elongate vertical member 12 in this embodiment described last, may also have a plurality of radially spaced-apart support members 26 as described above for the earlier embodiments and may also be modified to include a top plant pot 28 or a table top 30 as described above.

In still another embodiment, the vertical plant stand 10 has an elongate vertical member 12, means 14 for providing vertical support, and a plurality of elongated generally hook-shaped members 32 each radially spaced-apart around the elongate vertical member 12 as described above, where the upper end 12*a* of the elongate vertical member 12 has the spaced-apart support members 26. The support members 26 project outwardly from the elongate vertical member 12 and are upwardly directed. Further, they are aligned so as to be essentially on a same plane. In this embodiment, the means 14 for providing vertical support located at the lower end of the elongate vertical member is restable on a ground surface. Means 14 can be a planar member like base plate 14*a* or separate standard legs 14*c* or decorative legs 14*c* like table or lamp legs. Rod iron legs present a variety of possible decorative designs from which to choose.

This embodiment would have a plurality of plant pots 18, each having a central hole 18*a* at their respective bottom portions 18*b*. The central hole 18*a* of each of the plurality of plant pots 18 are sized so that when the distal portion 32*b* of each hook-shaped member 32, which is directed vertically upward is passed through the central hole 18*a* of each of the plurality of plant pots 18, the plant pots 18 can each be tilted at an angular configuration as described above.

Again, all the components of the stand 10 can be made from wood materials, metal materials, polymeric materials, reinforced composites of polymeric materials and combinations thereof.

As described in the previous embodiments, the vertical plant stand 10 can be configured to form a base of a table and a table top is in an overlying relationship with each of the at least three radially spaced-apart support members 26, which are aligned so as to be essentially on the same plane. Alternatively, a plant stand top plant pot 28 can be mounted in an overlying relationship with the upper end 12*a* of the vertical elongate member 12. The top plant pot 28 is also generally supported on its perimeter side 28*a* with the radially spaced-apart support members 26.

From a review of the drawings, it is clear that the elongate vertical member 12 could be hanged from its upper end 12*a* and the planar base member 14*a* can act as a stop for the bottom most plant. In this modified embodiment, the plant pots 18 can still be stacked. Further, a modified version of this embodiment is having the elongate vertical member 12 incorporate the hook-shaped members 32 on which the pots 18 can be supported as described above and as shown in the drawings. In this embodiment, the planar base member 14*a* need not be used. However, it is was threadedly connected to the elongate vertical member 12, then it could be removable to allow the placement of a base plant pot 16 below the hook-shaped members 32.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A vertical plant stand comprising:

a monolithically formed solid elongate vertical member having an upper end and a lower end;

the lower end having means for providing vertical support located at the lower end of the elongate vertical member; and two or more plant pots, each having a central hole at their respective bottom portions;

the central holes being sized so that when the elongate vertical member is passed through the central hole of each of the two or more plant pots, said two or more plant pots can each be tilted at an angle and stacked sequentially at approximately said angularly tilted configuration; and the two or more plant pots being sequentially stacked along said elongate vertical member at approximately said angularly tilted configuration, wherein said means for providing vertical support located at the lower end of the elongate vertical member is adapted to be one of insertable in the soil of a base plant pot, restable on a ground surface and buried in the soil below the ground surface.

wherein the means for providing vertical support located at the lower end of the elongate vertical member is a plurality of radially spaced-apart support legs in combination with an extension of said elongate member projecting below said legs, wherein when the means for providing vertical support at the lower end of the elongate vertical member is the plurality of radially spaced-apart support legs, each of said support legs is formed so as to provide a bracing effect with the elongate vertical member and the ground surface.

2. The vertical plant stand according to claim 1, wherein the elongate vertical member and the means for providing vertical support located at the lower end of the elongate vertical member are made from material selected from the group consisting of wood materials, metal materials, polymeric materials, reinforced composites of polymeric materials and combinations thereof.

3. The vertical plant stand according to claim 1, wherein the angularly tilted configuration of each of the two or more plant pots is about 60 to 80 degrees from horizontal.

* * * * *

UNITED STATES PATENT AND TRADEMARK OFFICE

CERTIFICATE OF CORRECTION

PATENT NO. : 6,983,561 B2
DATED : January 10, 2006
INVENTOR(S) : William Charles Warren It is certified that error appears in the above-identified patent and that said Letters Patent is hereby corrected as shown below:

Column 6,
Lines 12-14, replace "wherein said means for providing vertical support located at the lower end of the elongate vertical member is adapted to be one of insertable in the soil of a base plant pot, restable on a ground surface and buried in the soil below the ground surface." with -- wherein said means for providing vertical support located at the lower end of the elongate vertical member is configured to be in combination, restable on a ground surface and insertable in the soil below the ground surface, --.

Signed and Sealed this

Twenty-eighth Day of March, 2006

JON W. DUDAS
*Director of the United States Patent and Trademark Office*